US011400749B2

(12) United States Patent
Michenaud

(10) Patent No.: US 11,400,749 B2
(45) Date of Patent: Aug. 2, 2022

(54) MULTIFUNCTION WRITING INSTRUMENT

(71) Applicant: SOCIETE BIC, Clichy (FR)

(72) Inventor: Etienne Michenaud, Montrouge (FR)

(73) Assignee: SOCIETE BIC, Clichy (FR)

( * ) Notice: Subject to any disclaimer, the term of this patent is extended or adjusted under 35 U.S.C. 154(b) by 0 days.

(21) Appl. No.: 17/388,620

(22) Filed: Jul. 29, 2021

(65) Prior Publication Data

US 2021/0354498 A1 Nov. 18, 2021

Related U.S. Application Data

(62) Division of application No. 16/426,866, filed on May 30, 2019, now Pat. No. 11,104,179.

(30) Foreign Application Priority Data

May 31, 2018 (FR) ..... 1854710

(51) Int. Cl.
*B43K 24/12* (2006.01)
*B43K 24/18* (2006.01)
(Continued)

(52) U.S. Cl.
CPC ..... *B43K 24/12* (2013.01); *B43K 24/163* (2013.01); *B43K 24/18* (2013.01); *B43K 27/02* (2013.01); *B43K 27/12* (2013.01); *B43K 24/16* (2013.01)

(58) Field of Classification Search
CPC ..... B43K 24/12; B43K 24/20; B43K 24/14; B43K 24/146; B43K 24/16; B43K 24/163;
(Continued)

(56) References Cited

U.S. PATENT DOCUMENTS 5,749,663 A 5/1998 Takahashi
6,217,241 B1 4/2001 Kobayashi
(Continued)

FOREIGN PATENT DOCUMENTS

CH 331556 7/1958
DE 422418 11/1925
(Continued)

OTHER PUBLICATIONS

French Search Report corresponding to French priority application No. FR1854710, 4 pages.

*Primary Examiner* — David J Walczak
(74) *Attorney, Agent, or Firm* — Ohlandt, Greeley, Ruggiero & Perle, LLP

(57) ABSTRACT

Multifunction writing instrument comprising a body extending in an axial direction and housing at least two retractable writing elements and a ring portion movable in rotation. The ring portion having at least as many pairs of guide surfaces as retractable writing elements. The writing elements include buttons. Each button is configured to cooperate with a respective one of the pair of guide surfaces of the ring portion. Actuation of the button of a writing element facilitates movement of the writing element from the retracted position to the writing position and returns any of the other writing elements in the writing position to the retracted position, whereby at most, one writing element is in the writing position.

20 Claims, 8 Drawing Sheets

(51) Int. Cl.
*B43K 24/16* (2006.01)
*B43K 27/02* (2006.01)
*B43K 27/12* (2006.01)

(58) Field of Classification Search
CPC .... B43K 24/18; B43K 24/183; B43K 24/186; B43K 27/02; B43K 27/08; B43K 27/12
USPC ..... 401/29–33
See application file for complete search history.

(56) References Cited

U.S. PATENT DOCUMENTS

| | | | | |
|---|---|---|---|---|
| 7,008,131 | B2 * | 3/2006 | Kagevarna | B43K 24/146 401/35 |
| 2006/0222437 | A1 | 10/2006 | Ando | |
| 2015/0343832 | A1 | 12/2015 | Tani | |
| 2017/0151826 | A1 * | 6/2017 | Tani | B43K 27/04 |

FOREIGN PATENT DOCUMENTS

| | | |
|---|---|---|
| EP | 2762327 | 8/2014 |
| WO | 2009/070166 | 6/2009 |

* cited by examiner

MULTIFUNCTION WRITING INSTRUMENT

CROSS REFERENCE TO RELATED APPLICATION(S)

This application is a divisional of U.S. application Ser. No. 16/426,866, filed May 30, 2019, now U.S. Pat. No. 11,104,179, that claims priority to French Application FR1854710, filed May 31, 2018, the entire contents of which are incorporated herein by reference.

BACKGROUND

Field

The present disclosure relates to a multifunction writing instrument. As a reminder, a multifunction writing instrument is a writing instrument comprising a plurality of writing elements, each writing element can be used selectively.

Description of Related Art

The mechanisms of known multifunction writing instruments generally have a relatively significant space requirement allowing the presence of only a relatively limited number of writing elements. There is therefore a need in this regard.

SUMMARY

An embodiment relates to a multifunction writing instrument comprising a body extending along an axial direction and housing at least two retractable writing elements, each writing element comprising a writing tip and a button, each retractable writing element being movable between a writing position in which the writing tip protrudes from the body and a retracted position in which the writing tip is retracted within the body, and a ring portion movable in rotation about the axial direction, the ring portion having at least as many pairs of guide surfaces as retractable writing elements, each button being configured to cooperate with a pair of guide surfaces of the ring portion so that the actuation of a button of a retractable writing element for bringing said retractable writing element from the retracted position to the writing position returns any other possible retractable writing element in the writing position into its retracted position, whereby at most one retractable writing element can be in the writing position.

In a general manner, the axial direction corresponds to the direction of the axis of the body, and a radial direction is a direction perpendicular to the axis of the body. It is understood that an azimuthal or circumferential direction corresponds to the direction describing a ring around the axial direction. In addition, unless otherwise stated, the adjectives "inside"/"outside" or "inner"/"outer" are used with reference to a radial direction so that an inside (i.e. radially inside) part is closer to the axis of the body than an outside (i.e. radially outside) part.

Within the meaning of the present disclosure, a retractable writing element is formed by any retractable assembly comprising a writing tip and a button. The writing tip may be for example a felt tip, with a ballpoint or the like, a graphite lead, a mechanical pencil mechanism, a piece of chalk, and more generally any means for writing on a substrate, any (active or passive) tip configured to cooperate with a touch screen, for example a capacitive, resistive, inductive, infrared, optical, electrostatic screen, etc. or even a cosmetic applicator (brush, pencil, mascara brush, roll-on applicator, lipstick or any cosmetic application means), etc. The button may be formed of one single piece or in several separate pieces.

The body may be formed of one single piece or comprise several separate pieces. Within the meaning of the present disclosure, the body comprises all the pieces other than the writing element(s) and the ring portion. The body is of course hollow and configured to receive the writing elements. The body thus has an inside and an outside. The body may have a lateral opening, which is a through opening formed in a wall of the body and opening radially, to receive a button.

The term "ring portion" refers equally to a complete ring (i.e. extending azimuthally over 360°) or a ring portion (i.e. extending azimuthally over less than 360°). Of course, the ring is movable in rotation about an axis parallel to the axial direction, and therefore parallel to the axis of the body, this axis may be coincident with the axis of the body, but not necessarily.

Within the meaning of the present disclosure, a "guide surface" is a surface capable of cooperating with a portion of a button during the passage from the writing position to the retracted position, and vice versa, of a writing element. For example, an abutment surface, configured to cooperate in abutment with a button, or a rotational drive surface, configured to drive in rotation the ring portion when it cooperates with a button, are guide surfaces. Of course, one and the same guide surface may have several distinct portions, for example a portion forming an abutment surface and a portion forming rotational drive surface. By "cooperate with a pair of guide surfaces" is meant that at least one portion of a button comes into contact with at least one portion of a guide surface of the pair of guide surfaces so as to rotate the ring portion around the axial direction.

According to one variant, a single pair of guide surfaces is associated with each button. In other words, each button is configured to cooperate with one and the same pair of guide surfaces. According to another variant, each button can cooperate with different pairs of guide surfaces. For example, there is a number of pairs of guide surfaces that is an integer multiple of the number of retractable writing elements.

Within the meaning of the present disclosure, by "retractable writing element" is meant a retractable writing element configured to cooperate with the ring portion. Thus, for example, the writing instrument may comprise a retractable writing element that is not configured to cooperate with the ring portion, in which case this retractable writing element is not considered in the order relations in relation to the guide surfaces.

The ring portion and the buttons form a retraction mechanism for moving each retractable writing element between its writing position and its retracted position, and for holding the writing element in each of these positions. When a button is actuated, the latter cooperates with a pair of guide surfaces of the ring portion, which has the effect of moving the ring portion in the circumferential direction (i.e. in rotation about the axial direction). The displacement of the ring portion allows, on the one hand, another possible writing element in the writing position to return into the retracted position and, on the other hand, the writing element whose button is actuated to come into the writing position, and remain in the writing position.

The ring portion allows obtaining a retraction mechanism with reduced space requirement. In other words, thanks to the ring portion, an inside space, i.e. radially inside the ring portion, remains free. This space can therefore be used for other elements of the writing instrument, for example a retractable or fixed writing element. Compared to a multi-function instrument of the prior art, the ring portion provides a space saving for equipping the writing instrument according to the present disclosure with more writing elements than a writing instrument of comparable size of the prior art.

In some embodiments, each button comprises a pair of protrusions configured to cooperate with a pair of guide surfaces.

Such a configuration is relatively compact and allows obtaining a retraction mechanism with reduced requirement.

In some embodiments, the body extends in a radial direction and in a circumferential direction, the buttons being axially movable, the protrusions of each button protruding radially while being offset from each other in the circumferential direction and in the axial direction.

For example, each guide surface extends radially and axially and/or circumferentially. Such a configuration is relatively compact and allows obtaining a retraction mechanism with reduced space requirement.

In some embodiments, the body has a first end and a second end opposite to the first end in the axial direction, each pair of protrusions of each button having a first protrusion disposed on the side of the first end of the body and a second protrusion disposed on the side of the second end of the body, each pair of guide surfaces being associated with a shoulder of the ring portion extending transversely to the axial direction, the first protrusion of each button being configured to cooperate in abutment in the axial direction with the shoulder associated with the pair of guide surfaces with which said button cooperates to bring the writing element to which said button belongs into the writing position.

It is understood that there may be one or more shoulder(s) associated with each pair of guide surfaces. It is considered that a shoulder associated with a pair of guide surfaces is a shoulder that cooperates with the first protrusion of a button in the writing position, when said button has cooperated with said pair of guide surfaces to bring the writing instrument to which the button belongs into the writing position. It is understood that the shoulder extends only in the radial and circumferential directions. This shoulder forms an abutment cooperating with the first protrusion so as to hold the writing element in the writing position. Thus, to return the writing element into the retracted position, it is sufficient to rotate the ring portion around the axial direction in order to disengage the first protrusion from the shoulder, so that the writing element can return into the retracted position. Such a configuration is relatively compact and allows obtaining a retraction mechanism with reduced space requirement.

In some embodiments, at least one portion of a guide surface of each pair of guide surfaces is oriented towards the second end while the shoulder is oriented toward the first end.

It is therefore understood that all or part of a single surface or all or part of the two guide surfaces of each pair of guide surfaces is oriented towards the second end. In other words, the portion of the guide surface in question and the shoulder are axially oriented opposite each other. Such a configuration is relatively compact and allows obtaining a retraction mechanism with reduced space requirement.

In some embodiments, the body extends in a circumferential direction, the two guide surfaces of each pair of guide surfaces being spaced in the circumferential direction, a passage extending in the axial direction being formed between the two guide surfaces of each pair of guide surfaces.

In other words, each pair of guide surfaces delimits a passage. A protrusion can thus spread axially within the passage, by cooperating with one or more portion(s) of these guide surfaces. This allows, when a button of a writing element is actuated, rotating the ring portion and, once the ring portion has been rotated, holding the writing element actuated in the writing position. Such a configuration is relatively compact and allows obtaining a retraction mechanism with reduced space requirement.

In some embodiments, the body extends in a circumferential direction, at least two adjacent guide surfaces each belonging to a distinct pair among two pairs of guide surfaces adjacent in the circumferential direction, are formed by a single tooth.

In other words, within a pair of guide surfaces, one surface belongs to one tooth while the other surface belongs to another tooth. For example, the teeth protrude radially. For example, the ring portion comprises as many teeth as pairs of guide surfaces, the surfaces that are adjacent or facing each pair of adjacent teeth forming a pair of guide surfaces. Such a configuration is relatively compact and allows obtaining a retraction mechanism with reduced space requirement.

In some embodiments, the guide surfaces extend radially.

For example, a portion of a guide surface of the pair of guide surfaces also extends axially. For example, a portion of a guide surface of the pair of guide surfaces also extends axially and circumferentially.

In some embodiments, all the buttons are disposed radially outside the ring portion.

This allows obtaining a maximum of free space inside (i.e. radially inside) the ring portion.

In some embodiments, a writing element fixed with respect to the body extends radially inside the ring portion.

For example, the fixed element is a felt. Indeed, the free space inside the ring portion may be large enough to receive an ink tank, for example a fibrous ink tank.

In some embodiments, the body has a first end and a second end opposite to the first end in the axial direction, the fixed writing element having a writing tip protruding from the body from the second end while the writing tips of the retractable writing elements are configured to protrude from the body from the first end.

In other words, all the writing tips of the retractable writing elements are configured to protrude on the same side while the writing tip of the fixed writing element protrudes from the opposite side according to the axial direction. Such a configuration is relatively compact and allows equipping the writing instrument with a maximum of writing elements.

In some embodiments, a single button, called central button, is disposed radially inside the ring portion while all the other buttons are disposed radially outside the ring portion.

In other words, the writing instrument comprises a single central button and a plurality of peripheral buttons. However, it is understood that the central button is "central" and the other buttons are "peripheral" considered relative to the ring portion. Thus, the central button has a portion extending, facing the ring portion, radially inside, i.e. more in the center of the body than the ring portion while the peripheral buttons do not present such a portion. However, the central button may also comprise a portion disposed radially outside the ring portion. For example, the central button may comprise a lateral transmission. According to another example, the central button is coaxial with the geometric axis of the ring portion (which may itself be coaxial with the geometric axis of the body, but not necessarily).

For example, the peripheral buttons cooperate with pairs of guide surfaces disposed on an outside surface of the ring portion while the central button cooperates with a pair of guide surfaces disposed on an inside surface of the ring portion. Such a configuration is interesting when the writing element associated with the central button is particularly bulky with respect to the writing elements associated with the peripheral buttons. Such a configuration is relatively compact and allows equipping the writing instrument with a maximum of writing elements.

In some embodiments, the writing element comprising the central button is a mechanical pencil.

BRIEF DESCRIPTION OF THE DRAWINGS

The object of the present disclosure and its advantages will be better understood upon reading the detailed description given below of various embodiments given by way of non-limiting examples. This description refers to the pages of annexed figures, in which.

DETAILED DESCRIPTION

Figure 1:
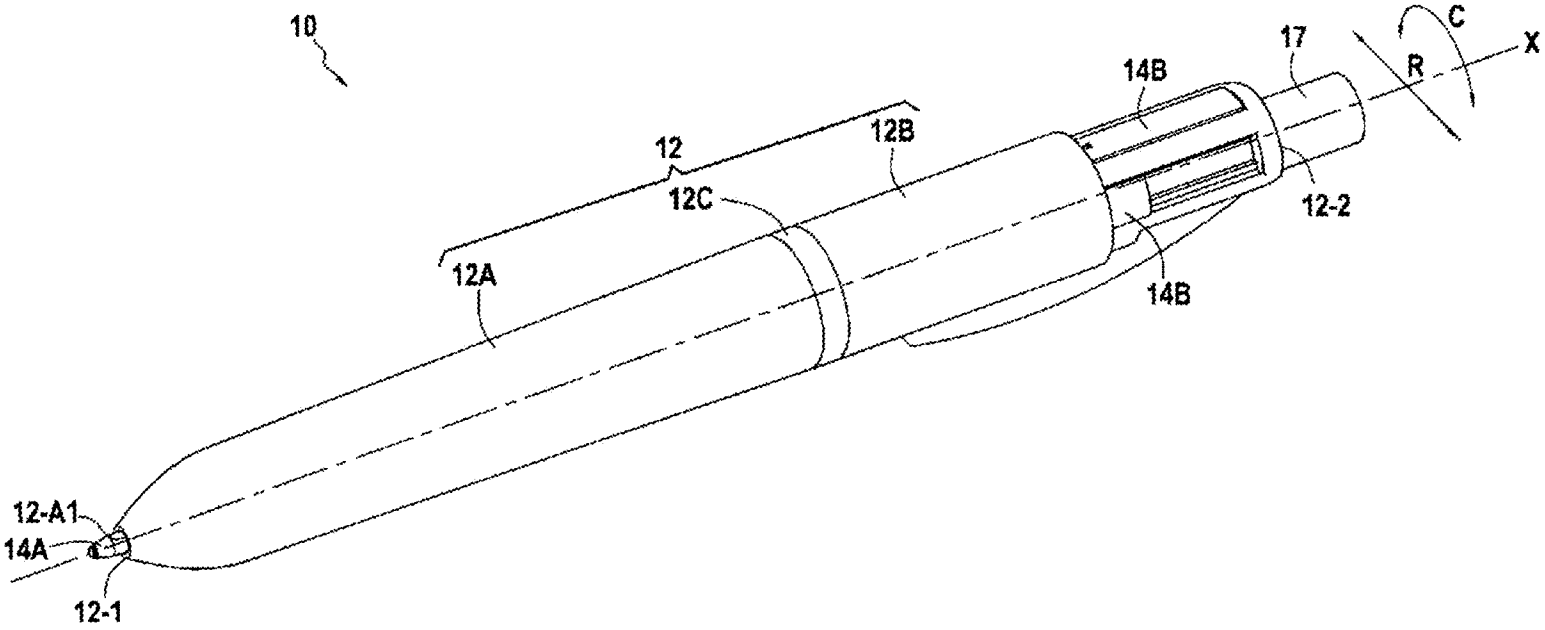
FIG. 1 represents a first embodiment of a writing instrument according to the present disclosure.
Figure 2:
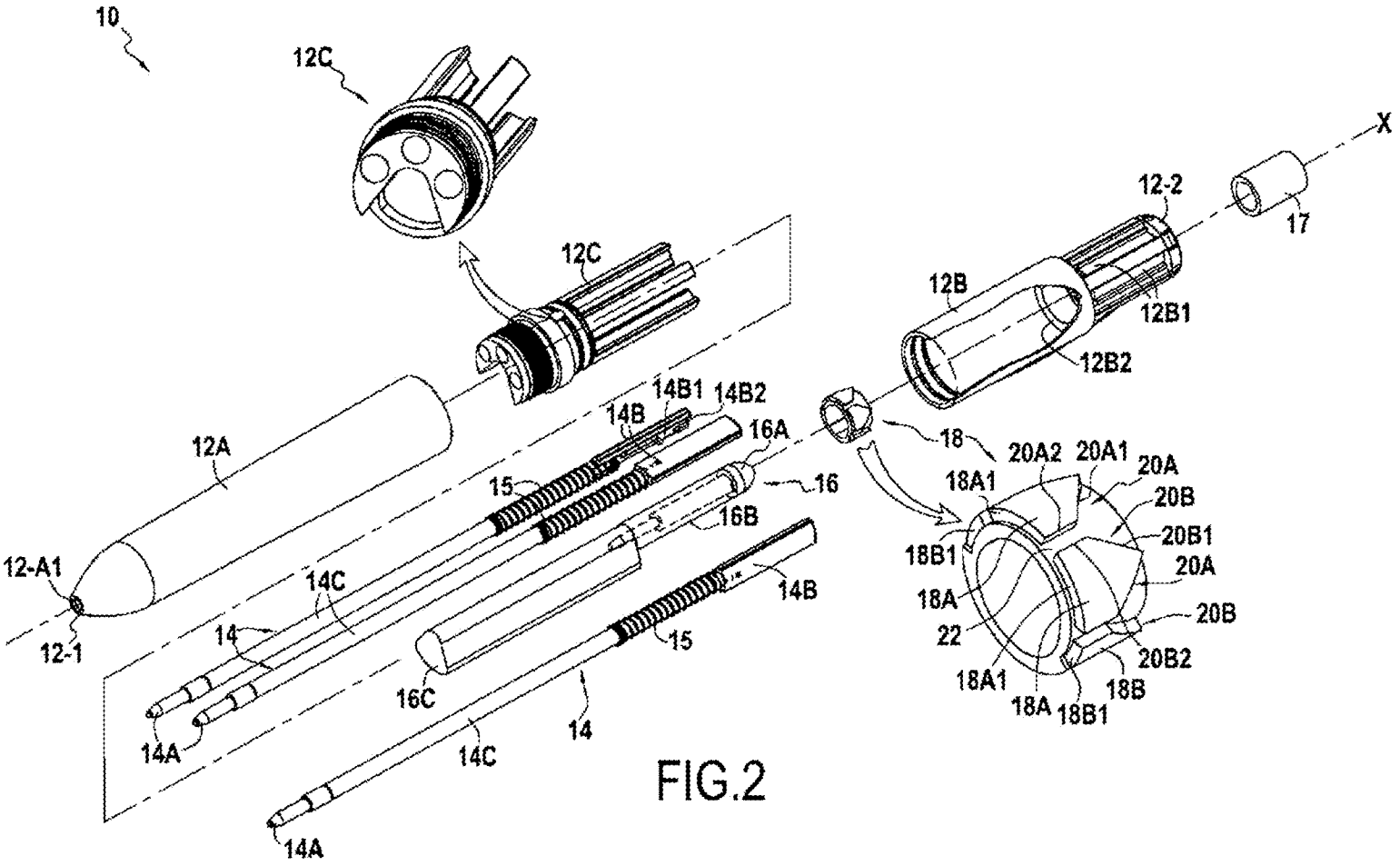
FIG. 2 represents the writing instrument of FIG. 1 exploded.

FIGS. 1 and 2 represent a first embodiment of a multifunction writing instrument 10 comprising a body 12 and a plurality of retractable writing elements 14, in this example three retractable writing elements 14. The body 12 extends in an axial direction X, in a radial direction R and in a circumferential direction C. The body 12 has a first end 12-1 with an orifice 12-A1 for the passage of writing tips 14A of the writing elements 14 and a rear end 12-2 opposite to the front end 12-1 in the axial direction X.

In this example, the body 12 comprises several parts, namely a first part 12A, a second part 12B and an intermediate part 12C on which are mounted the first part 12A and the second part 12B. The second part 12B has three lateral openings 12B1, in this case, lateral windows, each receiving a button 14B of a writing element 14 (described below). The openings 12B1 have a rectangular shape whose long side extends in the axial direction X and guide the buttons 14B in the axial direction X. Of course, according to one variant, there are more or less than three openings, and more or less than three writing elements 14.

In this example, the retractable writing elements 14 all have an identical writing tip, in this example a ballpoint 14A. Of course, according to one variant, the writing elements have writing tips different from each other. In this example, the buttons 14B of all the writing elements 14 are identical. Of course, according to one variant, the buttons may be different from one writing element to another. The button 14B of each writing element is connected to a writing tip 14A by a tank 14C, in this example an ink tank, each containing a color ink different from that of the other tanks.

In FIG. 1, a retractable writing element 14 is in the writing position, its writing tip 14A protruding from the body 12, while the other retractable writing elements 14 are in the retracted position, their writing tips 14A being retracted into the body 12.

The writing instrument 10 has a fixed writing element 16. The writing tip 16A of this fixed element 16 is protected by a removable cap 17. The writing tip 16A protrudes from the body 12 from the second end 12-2 of the body 12. The writing tip 16A is connected to a tank 16C housed in the body 12, by a duct 16B housed partly in the body 12 and extending partly out of the body 12. In this example, since the tank 16C is not cylindrical with a circular section but with a substantially triangular section, the dimensions of the tank 16C in the radial direction are greater than the diameter of the duct 16B. According to one variant, the tank 16C is cylindrical with a circular section, and its diameter is larger than that of the passage 16B.

The writing instrument 10 comprises a ring portion 18, in this example a ring (or complete ring). This ring 18 is movable in rotation about the axial direction X and blocked in translation in the X direction between the intermediate part 12C and an inner shoulder 12B2 of the second part 12B. In this example, the ring 18 is fitted around the duct 16B, and free in rotation around the duct 16B. In this example, the inside wall of the ring is circular, but could in a variant have a different (for example ovoid) shape, for example to address space requirement issues. According to another variant, the ring 18 cooperates with a rotating stroke limiter, for example to avoid any risk of misalignment of the guide surfaces with the buttons (i.e. to ensure angular positioning of the ring within the writing element).

In this example, the ring 18 has an outer (i.e. radially outer) face having as many pairs of guide surfaces 20A, 20B as movable writing elements 14. More particularly, the ring 18 has three first guide surfaces 20A, each first guide surface 20A being associated with a single button 14B and three second guide surfaces 20B, each second guide surface 20B being associated with a single button 14B, so that a single pair of guide surfaces 20A, 20B is associated with each button 14B.

In this example, the first and second guide surfaces 20A and 20B each have a first portion 20A1, 20B1 and a second portion 20A2, 2062, contiguous to the first portion 20A1, 2061, respectively. The first portions 20A1, 20B1 each form a rotational drive surface of the ring 18 while the second portions 20A2, 2062 each form an abutment surface. The first portions 20A1, 20B1 of the guide surfaces 20A, 20B extend radially, axially and circumferentially, while the second portions 20A2, 2062 of the guide surfaces 20A, 20B extend radially and axially only. In other words, the second portions 20A2, 2062 extend parallel to the axial direction X while the first portions 20A1, 20B1 are inclined relative to the axial direction X and oriented towards the second end 12-2 of the body 12. It should be noted that the inclination of the first portion 20A1 is opposite to the inclination of the first portion 2061. In other words, in this example, in each guide surface 20A, 20B, the inclination of the first portions 20A1, 20B1 is oriented so that the first portions 20A1, 20B1 are set back in the circumferential direction C, relative to the second portion 20A2, 2062, respectively. In other words, the first portions 20A1 and 20B1 are set back in opposite directions along the circumferential direction C.

Within each pair of guide surfaces 20A, 20B, the two guide surfaces are spaced in the circumferential direction C and facing one another. In other words, in this example, given the orientation of the guide surfaces 20A and 20B, they face each other in the circumferential direction C. Each pair of guide surfaces 20A, 20B thus delimits a passage 22. The portion of the passage 22 delimited only by the second portions 20A2, 2062 is straight and extends axially. The remainder of the passage, i.e. the portion of the passage 22 delimited by at least a first portion 20A1, 2061, forms a convergent extending axially and opening into the straight portion. The convergent is convergent in the axial direction X from the second end 12-2 to the first end 12-1.

The guide surfaces 20A, 20B are formed by teeth 18A, 18B of the ring 18. More particularly, the ring has on its outer face two identical teeth 18A each extending over 60° (angle of sixty degrees) and a tooth 18B extending over 200° (angle of two hundred degrees), the teeth being spaced two by two in the circumferential direction by a passage 22. Each tooth 18A, 18B has a first circumferential end face ring forming a first guide surface 20A and a second circumferential end face, opposite to the first circumferential end face, in the circumferential direction C, forming a second guide surface 20B. In this example, the two circumferential end faces (i.e. the first and second guide surfaces 20A and 20B) of each tooth 18A are contiguous with their first portions, so that each tooth 18A has a triangular shape on the side of the second end 12-2 of the body 12. The two circumferential end faces (i.e. the first and second guide surfaces 20A and 20B) of the tooth 18B are spaced circumferentially, so that the tooth 18B has a trapezoidal shape on the side of the second end 12-2 of the body 12. Also, according to one variant, the ring 18 could be replaced by a ring portion where, compared to the ring 18, the part extending between the two circumferential end faces of the tooth 18B would be removed. According to yet another variant, the tooth 18B could be replaced by two "half-teeth" each having a circumferential end face of the tooth 18B, and spaced circumferentially.

In other words, in the present example, within the ring 18, two adjacent guide surfaces 20A, 20B each belonging to a distinct pair among two pairs of guide surfaces 20A, 20B adjacent in the circumferential direction C are formed by a single tooth 18A or 18B.

Each tooth 18A, 18B forms on the side of the first end 12-1 of the body 12, a shoulder 18A1, 18B1 extending transversely to the axial direction X. Thus, there is a shoulder 18A1 and/or 18B1 associated with each pair of guide surfaces 20A, 20B.

The buttons 14B of all the retractable writing elements 14 are disposed radially outside the ring 18. Each button 14B has a pair of protrusions extending radially towards the inside, namely a first protrusion 14B1 and a second protrusion 1462. The pair of protrusions 1461, 14B2 of each button 14B is configured to cooperate with a pair of guide surfaces 20A, 20B of the ring 18. The protrusions 14B1 and 14B2 of the buttons 14B are facing the guide surfaces 20A, 20B of the ring 18. The first and second protrusions of each button 14B are, within each button 14B, offset in the circumferential direction C and in the axial direction X (see FIG. 3A). The first protrusion 14B1 is disposed on the side of the first end 12-1 of the body 12 while the second protrusion 14B2 is disposed on the side of the second end 12-2 of the body 12.

In this example, the retractable writing elements 14 are disposed at the periphery of the ring 18, and held in the intermediate part 12C and/or the second part 12B of the body 12 (depending on the position of the writing element in question), within the body 12 over an angular extent of about 144°. This allows releasing a central space (facing the ring 18) to pass, on the one hand, the duct 16B axially through the ring 18 and, on the other hand, a central and peripheral space (facing the ring 18) to house the ink tank 16C within the body 12. Thus, in this example, the tank 16C has, in axial section X, a substantially triangular shape. The tank 16C and the tanks 14C are inscribed in a circle defined by the body 12. According to a variant not represented, the retractable writing elements 14 are evenly distributed over the entire periphery of the ring 18, outside the ring 18, while the tank 16C is cylindrical with a circular section and coaxial with the ring 18 (i.e. the tank 16C is in the central position relative to the tanks 14C).

Note that the intermediate part 12C carries the retractable writing elements 14 within the body 12, the retractable writing elements 14, and more particularly in this example, the tanks 14C, extending on either side of the intermediate part 12C, the buttons 14 being disposed on the side of the second end 12-2 while the writing tips 14A are disposed on the side of the first end 12-1.

Each retractable writing element 14 is equipped with a compression spring 15 whose ends are respectively in bearing against the intermediate part 12C of the body 12 and against the button 14B, whereby the button 14B tends to move axially towards the second end 12-2 of the body 12.

The operation of the writing instrument 10 to pass a retractable writing element 14 from the retracted position to the writing position, and vice versa, will now be described with reference to FIGS. 3A to 3H.

Figure 3A:
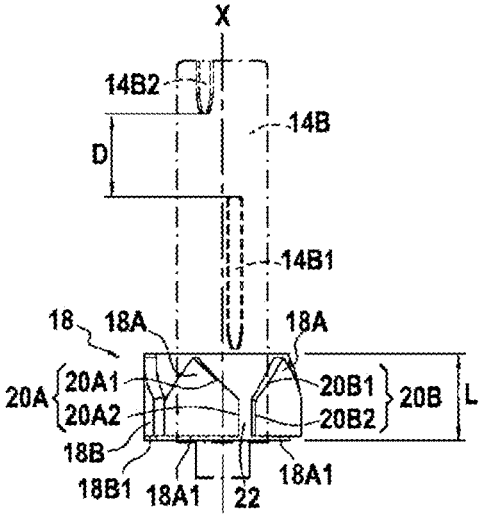
FIGS. 3A to 3H represent the kinematics of the ring portion of the writing instrument according to the first embodiment during the passage of a writing element from the retracted position to the writing position.
Figure 3B:
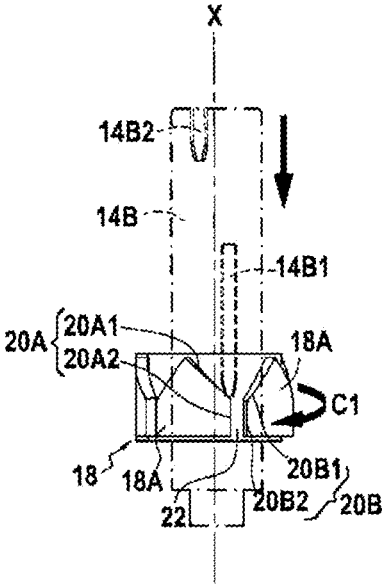
Figure 3C:
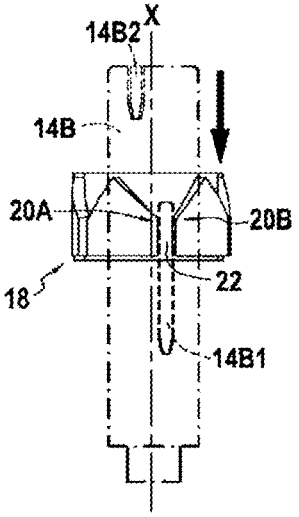
Figure 3D:
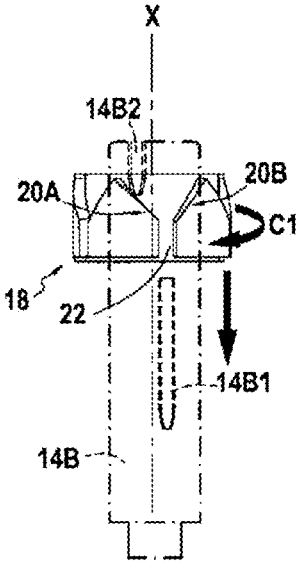
Figure 3E:
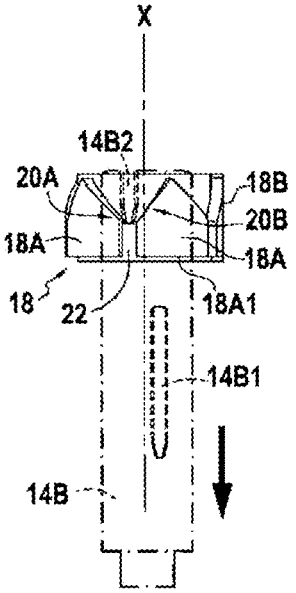

In FIG. 3A, all the writing elements 14 are in the retracted position (a single button 14B being represented), the springs 15 pushing the writing elements 14 towards the second end 12-2 (i.e. upwards in FIGS. 3A to 3H), thereby holding them in the retracted position. The first protrusion 14B1 of each button 14B is facing, in the axial direction, a passage 22. In order to bring a writing element 14 into the writing position, it is necessary to axially move the button 14B of the writing element in question towards the first end 12-1 of the body 12 (i.e., downwards in FIGS. 3A to 3H), as represented by the vertical arrow in FIGS. 3B-3E. During this displacement, the first protrusion 14B1 enters the convergent portion of the passage 22 facing and cooperates with the first portion 20A1 of the guide surface 20A (see FIG. 3B), whereby the ring 18 rotates about the axial direction X in a first circumferential direction C1 until the first protrusion enters the straight portion of the passage 22 (see FIG. 3C). Note that in this example, the ring 18 is free in rotation when no writing element is in the writing position so that the first protrusion 14B1 can be facing a first portion 20A1 or 20B1. It is of course understood that in the latter case, the ring rotates in the direction C2, opposite to the direction C1, when it cooperates with the first protrusion 14B1.

By continuing the axial displacement of the button 14B, the first protrusion 14B1 disengages from the passage 22 while the second protrusion 14B2 cooperates with the first portion 20A1 of the guide surface 20A (see FIG. 3D), which has the effect of rotating the ring 18 in the first circumferential direction C1, until the second protrusion 14B2 engages in the straight portion of the passage 22 (see FIG.

Figure 3F:
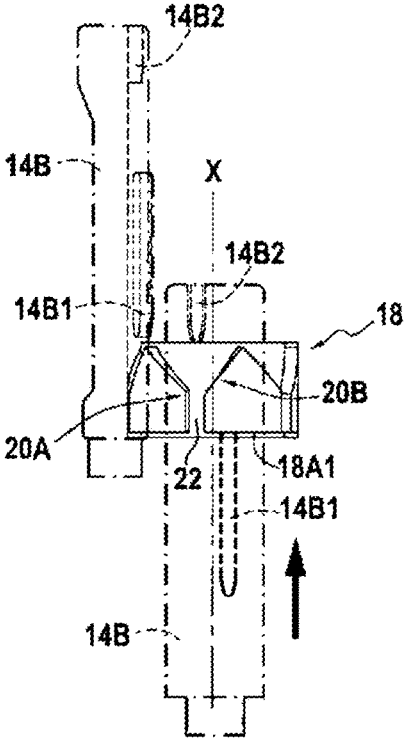

3E). The axial stroke of the button 14B is completed and limited in this example by an inner shoulder of the body 12 against which the writing element 14 abuts. In this position, the shoulder 18A1 is facing, in the axial direction X, the first protrusion 14B1. When the user releases the pressure exerted on the button 14B, the spring 15 pushes the button 14B towards the second end 12-2, as indicated by the arrow of FIG. 3F, whereby the first protrusion 14B1 cooperates axially in abutment against the shoulder 18A1, which holds the retractable writing element 14 in the writing position (see FIG. 3F). Of course, the movements described above are strictly similar and the description above can be directly transposed to the other buttons and teeth, and in particular to the tooth 18B.

Figure 3G:
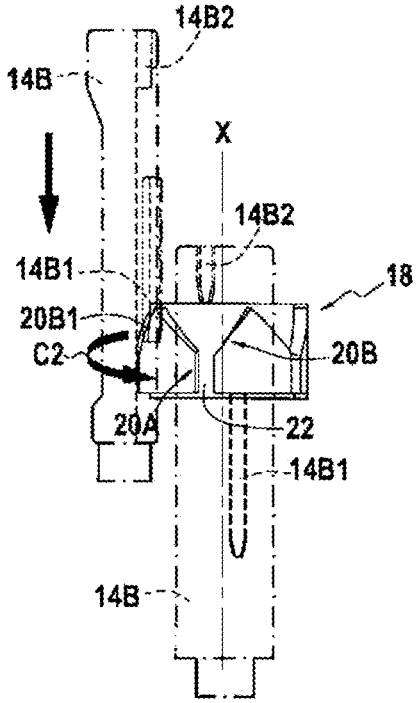
Figure 3H:
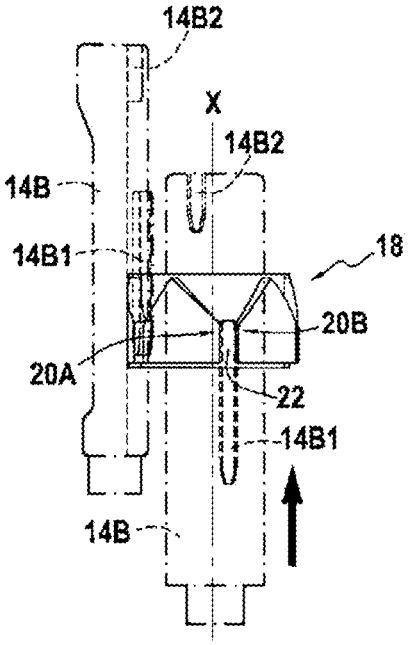

Note that when a retractable writing element 14 is in the writing position, all the first protrusions 14B1 of the buttons 14B of the other writing elements 14, which are in the retracted position, are axially facing the portions 20B1 of the guide surfaces 20B, as shown in FIG. 3F for the button adjacent to the button actuated during the movement described above with reference to FIGS. 3A to 3F. Note that for clarity of the figures, a single other adjacent button is represented in FIGS. 3F to 3H. Thus, when another writing element 14 is actuated by pushing its button 14B towards the first end 12-1, as represented by the vertical arrow in FIG. 3G, the first protrusion 14B1 of this button cooperates with the first portion 20B1 of the facing guide surface 20B, whereby the ring is rotated in a second circumferential direction C2, opposite to the first circumferential direction C1, which has the effect of disengaging the first protrusion 14B1 from the button 14B of the writing element 14 already in the writing position of the shoulder 18A1, whereby, under the effect of the spring 15, this first protrusion 14B1 will be able to engage in the passage 22 so that this writing element in the writing position returns into the retracted position (see FIG. 3H). If the user stops his movement and removes the pressure he exerts on the button 14B of the other writing element 14, then this other writing element 14 will automatically return into the retracted position under the effect of the spring 15. We will be then in the configuration of FIG. 3A. If, on the contrary, the user continues his movement, then the kinematics described with reference to FIGS. 3C to 3F applies, so that this other retractable writing element comes into the writing position. Thus, at most one retractable writing element can be in the writing position.

In this example, the ring 18 makes a reciprocating movement in rotation in the directions C1 and C2 so as to block or release a retractable writing element 14 in the writing position.

Note that the axial distance D (see FIG. 3A) between the protrusions 14B1 and 14B2 is greater than the axial length L of the passages 22, whereby it is ensured that a single protrusion cooperates with both the pair of guide surfaces 20A, 20B. Note also that the buttons 14 being movable only in the axial direction X, and blocked in the circumferential direction C by the edges of the windows 12B1 receiving them, when a second portion 20A2, 2062 cooperates with a protrusion of a button 14B, it is necessarily in the circumferential direction C, which blocks the unwanted rotational movements of the ring 18. The second portions 20A2 and 2062 therefore form indeed abutment surfaces. Since the ring 18 is blocked in translation in the axial direction X, but free in rotation about the axial direction X (i.e. in the circumferential direction C), when a first portion 20A1, 20B1 cooperates with a protrusion of a button 14B, it is necessarily a protrusion that cooperates axially against a first portion, which has the effect of driving the ring 18 in rotation. The first portions 20A1 and 20B1 therefore form indeed rotational drive surfaces of the ring 18.

A second embodiment will be described with reference to FIGS. 4 and 4A. The writing instrument 110 according to the second embodiment is similar to the writing instrument 10 according to the first embodiment except for the number and distribution of the retractable writing elements, the ring and the absence of a fixed writing element. The similar elements have the same reference sign and are not described again, while the comparable but different elements have their reference sign incremented by 100.

In this example, the ring portion 118 is a ring (or complete ring), comprising on its outside face only teeth 18A (i.e. identical to the teeth 18A described with reference to the first embodiment), evenly distributed over the entire periphery of the ring 118. In addition, two pairs of guide surfaces 120A, 120B are arranged in the inside face of the ring 118. The writing instrument 110 comprises five retractable writing elements 14 and one retractable writing element 114. The buttons 14B of the writing elements 14 are evenly distributed outside and around the ring 118, and therefore form peripheral buttons. The buttons 14B cooperate with the teeth 18A in the same manner as described above with reference to the first embodiment. The button 114B of the writing element 114 extends inside the ring 118 and therefore forms a central button. Note that the button protrudes axially from the body 12 by the second end 12-2 while the writing tip 114A is configured to protrude from the body 12, in the writing position, from the first end 12-1, via the orifice 12-A1. In this example, the retractable writing element 114 is a mechanical pencil. Thus, the tip 114A is a mechanical pencil mechanism while the tank 114C extending between the tip 114A and the button 114B is a lead tank. According to a variant, the tip 114A and the tank 114C could be similar to the tips 14A and tanks 14C.

Compared to the first embodiment, the writing instrument 110 having a different number of retractable writing elements and having no fixed writing element, the second part 112B and the intermediate part 112C of the body 12 are different from the second part 12B and from the intermediate part 12C of the first embodiment. However, the first part 12A remains identical, as well as the assembly of the different parts. Thus, the second part 112B differs from the second part 12B only in that it has five lateral openings 12B1 rather than three, each receiving a button 14B of a writing element 14, these five openings being evenly distributed in the circumferential direction C. Similarly, the intermediate part 112C differs from the intermediate part 12C only in that it is configured to receive and carry five retractable writing elements 14 rather than three, and the retractable writing element 114 rather than the fixed element 16. In this example, the ring 118 is blocked axially between a shoulder 11262 of the second part 112B and a shoulder 112C1 of the intermediate part 112C, and fitted around the tank 114C and free in rotation around the tank 114C of the writing element 114.

Figures 4, 4A:
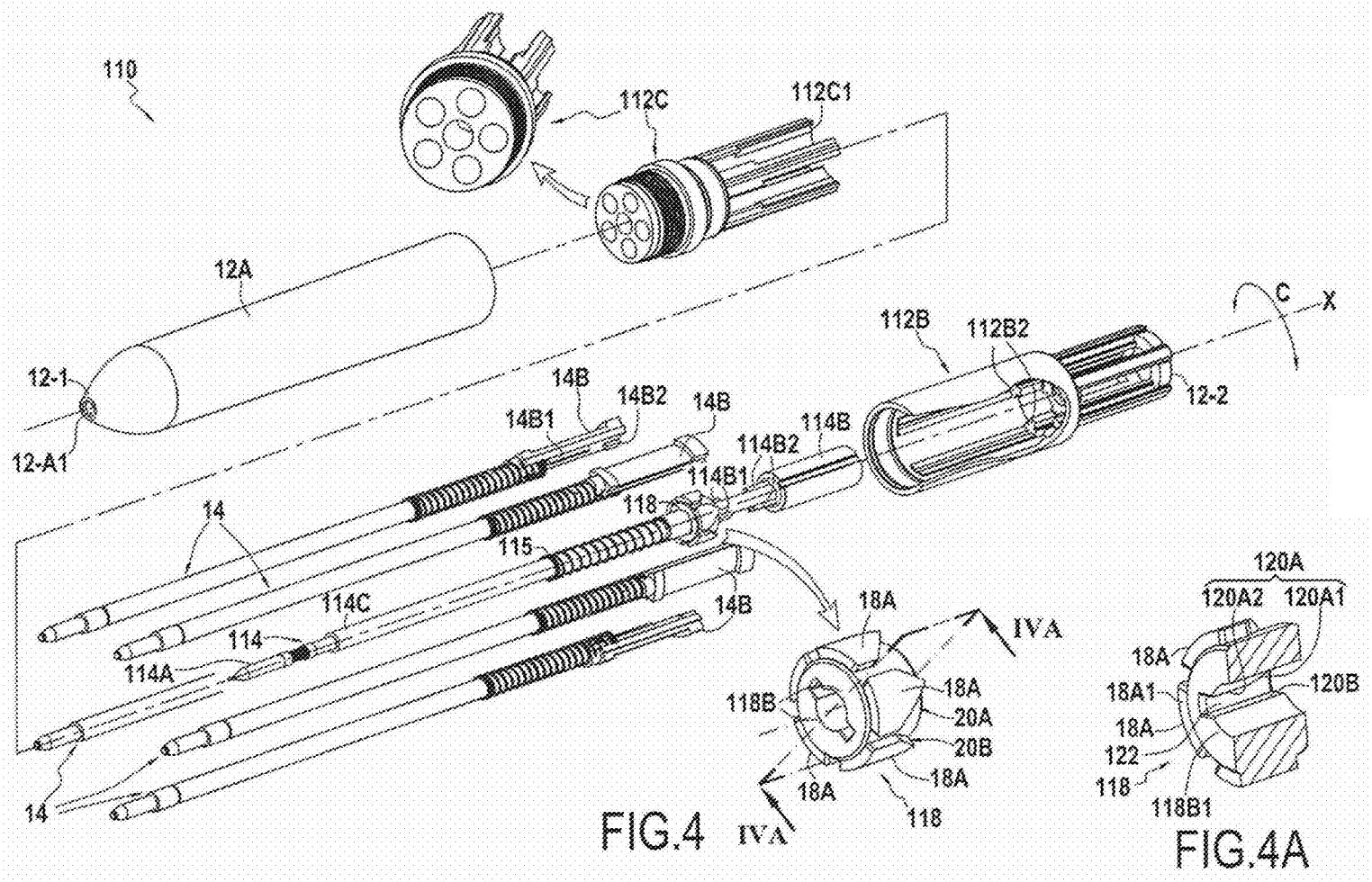
FIG. 4 represents a second embodiment of a writing instrument according to the present disclosure.
FIG. 4A represents a sectional view of the ring of FIG. 4, according to the plane IVA.
Figures 5, 5A:
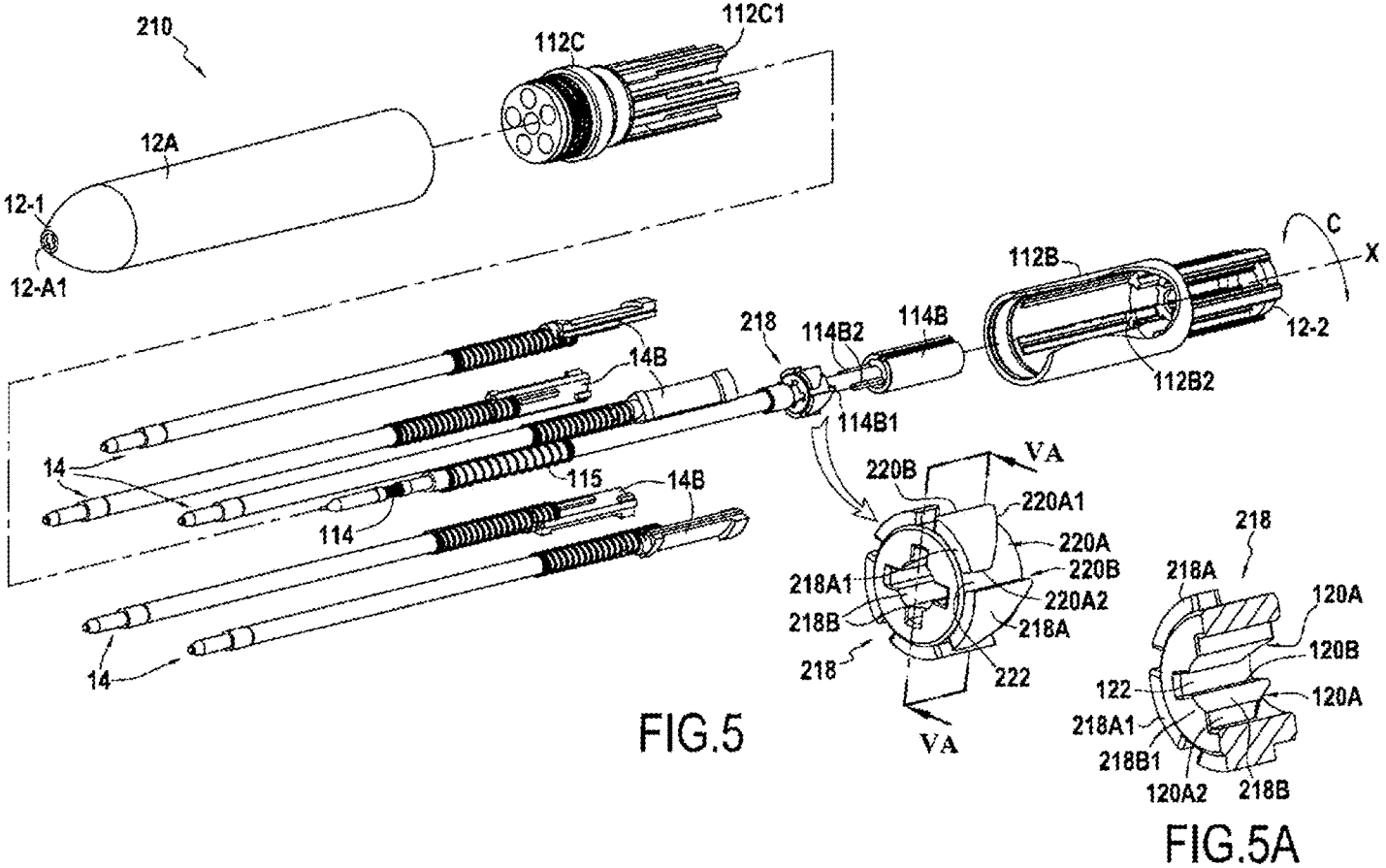
FIG. 5 represents a third embodiment of a writing instrument according to the present disclosure.
FIG. 5A represents a sectional view of the ring of FIG. 5, according to the plane V5.

A pair of guide surfaces 120A, 120B arranged inside the ring 118 is represented on the section of the ring of FIG. 4. The first guide surface 120A is identical to the first guide surface 20A (and oriented towards the second end 12-2), and has a first portion 120A1 and a second portion 120A2. The second surface 120B has a single portion forming an abutment surface extending radially and axially only. The two guide surfaces 120A, 120B are spaced in the circumferential direction by a passage 122. The two pairs of guide surfaces 120A, 120B are diametrically opposite. Similarly to the tooth 18B of the first embodiment, the first and second guide surfaces 120A and 120B form circumferential end faces of a tooth 118B, these faces being circumferentially spaced, so that each tooth 118B has a trapezoidal shape on the side of the second end 12-2 of the body 12.

The two pairs of guide surfaces 120A, 120B are configured to cooperate each with a pair of protrusions 114B1, 114B2 of the button 114B. In other words, the two pairs of protrusions 114B1, 114B2 of the button 114B are diametrically opposite. The protrusions 114B1, 114B2 protrude radially, and within each pair 114B1, 114B2, the protrusions are offset from each other in the axial direction X and in the circumferential direction C. In addition, within each pair of protrusions, the first protrusion 114B1 is disposed on the side of the first end 12-1 of the body 12 and the second protrusion 114B2 is disposed on the side of the second end 12-2 of the body 12. The ring 118 has two shoulders 118B1 extending transversely to the axial direction X, the first protrusion 114B1 of each pair of protrusions being configured to cooperate in abutment in the axial direction X with a shoulder 118B1, oriented towards the first end 12-1, when the writing element 114 is in the writing position.

Note that the ring 118 has as many teeth 18A, defining as many pairs of guide surfaces 20A, 20B, as writing elements 14 and two pairs of guide surfaces 120A, 120B for the writing element 114. In other words, the ring 118 has at least as many pairs of guide surfaces 20A, 20B; 120A, 120B as retractable writing elements 14, 114.

The buttons 14B and the associated guide surfaces 20A, 20B being identical to the first embodiment, the operation to bring a writing element 14 into the writing position is identical to the first embodiment and is not described again. The central button 114B being unique, a single guide surface identical to a guide surface among the pair of guide surfaces 20A, 20B is required, in this example the surface 120A similar to the surface 20A. Indeed, the surface 20B serving mainly for the return of a first writing element into the retracted position when it is in the writing position, thanks to the displacement of a second writing element, the surfaces 20B outside the ring 118 are sufficient. Indeed, the ring 118 making, similarly to the ring 18, reciprocating movements in the circumferential direction, it is ensured that the first protrusion 114B1 is always facing a passage 122. According to a variant, in order to secure this alignment, the writing instrument 110 is configured so that the protrusions 114B1 of the writing element 114 are always partly engaged in the facing passage 122, whereby the alignment of the ring 118 with the buttons 14, 114 (i.e. the angular positioning of the ring within the writing instrument 110) is ensured. Of course, those skilled in the art will size the angular extents of the passages 122 accordingly to avoid any blocking. When the central button is actuated so as to be pushed towards the first end 12-1, the first protrusion engages in the passage 122. By continuing the movement, it is then the second protrusion 114B2 that cooperates with the first surface 120A, similarly to what is described with reference to FIGS. 3C to 3F. The writing instrument 114 is then in the writing position. Note that when it is desired to advance a lead within the lead advance mechanism 114A, the protrusions 11461 and 11462 are axially free towards the first end facing the surfaces 120A, 120B, whereby it is possible to push the mechanism 114A in abutment inside the body 12 against a shoulder (not represented) of the first part 12A, which has the effect, in a known manner, of actuating the mechanism 114A and advancing a lead.

A third embodiment will be described with reference to FIGS. 5 to 7H. The writing instrument 210 according to the third embodiment is similar to the writing instrument 110 according to the second embodiment except for the ring. Similar elements have the same reference sign and are not described again, while the comparable but different elements have their reference sign incremented by 100.

The ring 218 differs from the ring 118 in that it has, on its outside face, teeth 218A rather than teeth 18A and in that it has, on its inside surface, four pairs of guide surfaces 120A, 120B rather than two.

The ring 218 has five teeth 218A that define five pairs of guide surfaces 220A, 220B. Thus, each tooth 218A defines, on the one hand, a first surface 220A of a pair of guide surfaces and, on the other hand, a second guide surface 220B of another pair of adjacent guide surfaces. Within each pair, the first guide surface 220A is circumferentially spaced from the second guide surface 220B by a passage 222. The first guide surface has a first portion 220A1 inclined with respect to the axial direction X and forming a rotational drive surface of the ring 218 and a second portion 220A2 parallel to the axial direction X and forming an abutment surface. Thus, the first surface 220A1 extends radially, axially and circumferentially while the second portion 220A2 extends only radially and axially. The first portion 220A1 is oriented towards the second end 12-2. The second surface 220B comprises only one portion extending radially and axially, and forms an abutment surface. Within each tooth, the first portion 220A1 of the first surface 220A is contiguous with the second surface 220B, so that each tooth 218A has a triangular shape on the side of the second end 12-2 of the body 12. Each tooth 218A forms on the side of the first end 12-1 a shoulder 218A1 extending transversely to the axial direction X.

On the inner face, the ring 218 has four teeth 218B that have circumferential end faces 120A, 120B similar to the circumferential end faces 120A, 120B of the teeth 118B of the ring 118 of the second embodiment, these surfaces being contiguous. Thus, unlike the teeth 118B, the teeth 218B have a triangular shape rather than a trapezoidal shape on the side of the second end 12-2.

The operation of the writing instrument 210 for passing a retractable writing element 14 or 114 from the retracted position to the writing position, and vice versa, will now be described with reference to FIGS. 6A to 6H.

First of all, note that both on the outer face and on the inner face of the ring 218, thanks to the triangular shape of the teeth on the side of the second end, all the adjacent passages 222 are contiguous in the circumferential direction and all adjacent passages 122 are contiguous in the circumferential direction. Thus, whatever the angular position of the ring 218, the first protrusions of the buttons 14B and 114B are always facing, in the axial direction, a passage 222, 122, respectively. Consequently, unlike the first and second embodiments, a device for ensuring a predetermined angular positioning of the ring would be superfluous within the context of this third embodiment.

Figure 6A:
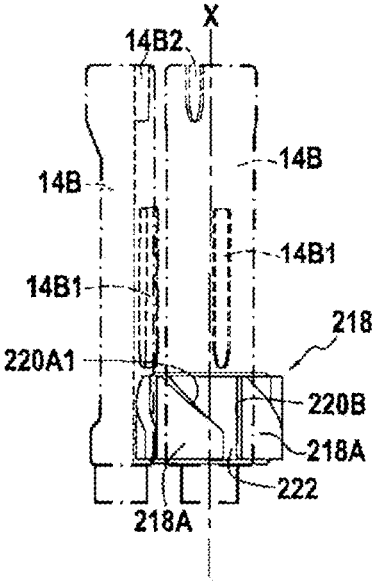
FIGS. 6A to 6H represent the kinematics of the ring portion of the writing instrument according to the second embodiment during the passage of a writing element from the retracted position to the writing position.
Figure 6B:
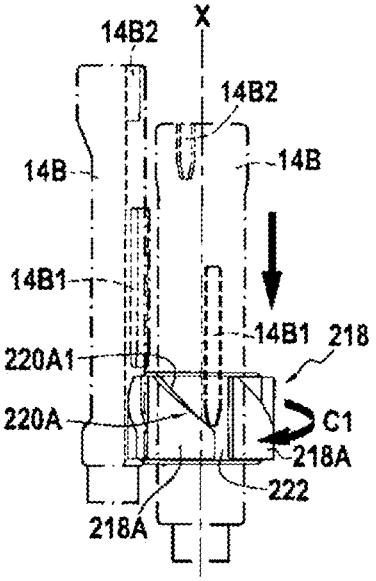
Figure 6C:
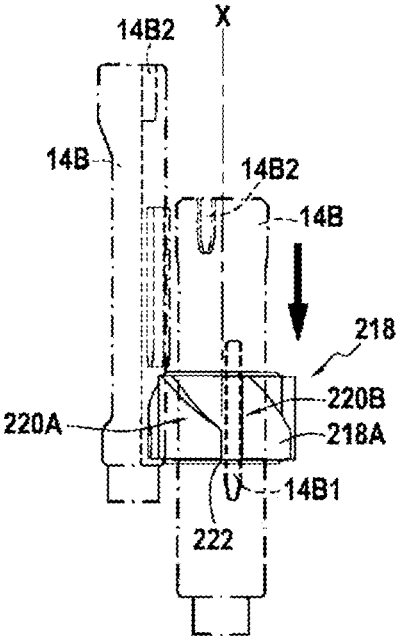
Figure 6D:
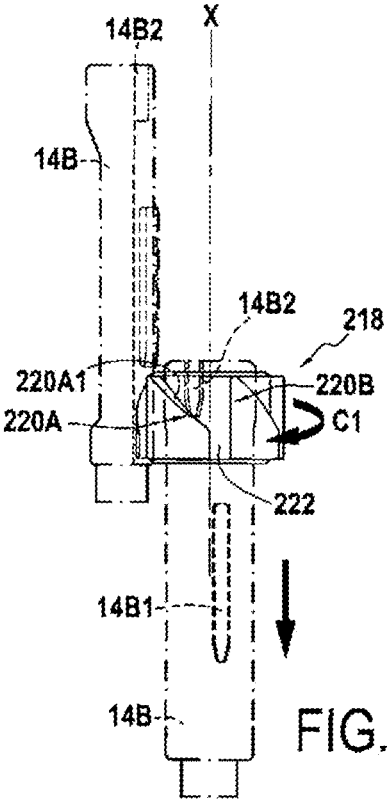

In FIG. 6A, all the writing elements 14 and 114 (only two buttons 14B being represented) are in the retracted position, the springs 15 and 115 pushing the writing elements 14 and 114 towards the second end 12-2 (i.e., upwards in FIGS. 6A to 6H), thereby holding them in the retracted position. The first protrusion 14B1, 114B1 of each button 14B, 114B is facing, in the axial direction, a passage 222, 122. In order to bring a writing element 14 (or 114) into the writing position, the button 14B (or 114B) of the writing element in question must be axially moved towards the first end 12-1 of the body 12 (i.e., downwards in FIGS. 6A to 6H), as represented by the vertical arrow in FIGS. 6B to 6E. During this displacement, the first protrusion 14B1 enters the convergent portion of the facing passage 222 and optionally cooperates with the first portion 220A1 of the guide surface 220A (see FIG. 6B), whereby the ring 218 rotates about the axial direction X in a circumferential direction C1 until the first protrusion enters the straight portion of the passage 222 (see FIG. 6C).

Figure 6E:
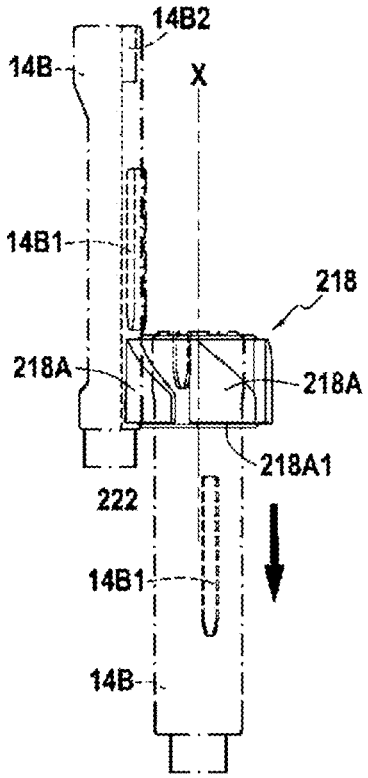
Figure 6F:
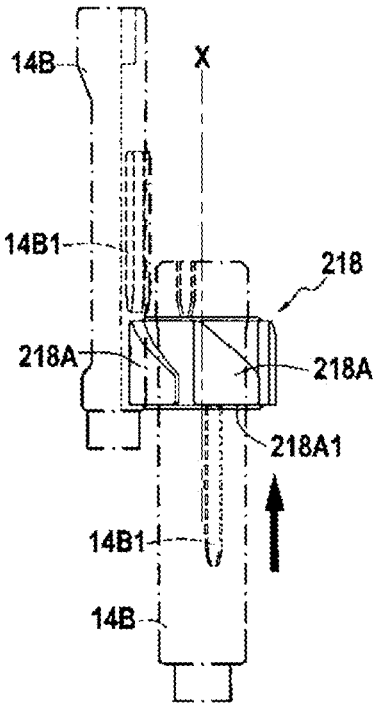
Figure 6G:
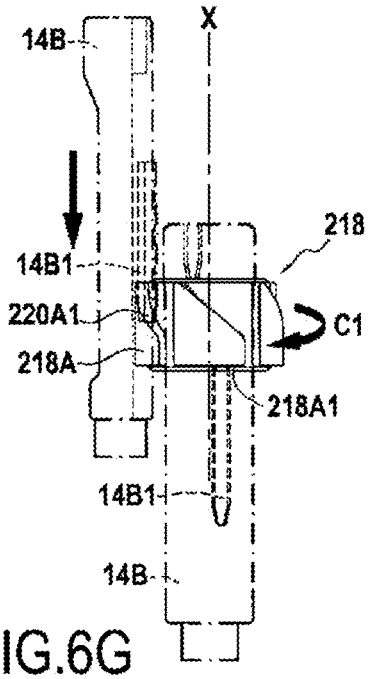
Figure 6H:
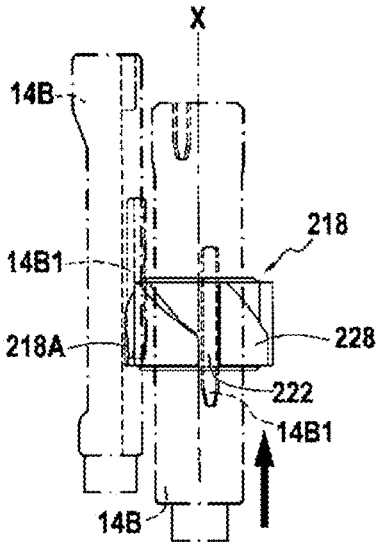

By continuing the axial displacement of the button 14B (or 114), the first protrusion 14B1 disengages from the passage 222 while the second protrusion 14B2 cooperates with the first portion 220A1 of the guide surface 220A (see FIG. 6D), which has the effect of rotating the ring 18 in the circumferential direction C1 until the second protrusion 1462 engages in the straight portion of the passage 222 (see FIG. 6E). The axial stroke of the button 14B (or 114B) ends and is limited in this example by an inner shoulder of the body 12 against which the writing element 14/114 abuts. In addition, this shoulder is also used to actuate the lead advance mechanism 114A. In this position, the shoulder 218A1 is facing, in the axial direction X, the first protrusion 1461. When the user releases the pressure exerted on the button 14B (or 114), the spring 15 (or 115) pushes the button 14B (or 114B) towards the second end 12-2, as indicated by the arrow of FIG. 6F, whereby the first protrusion 14B1 (or 11461) cooperates axially in abutment against the shoulder 118A1 (or 21861), which holds the retractable writing element 14 (or 114) in the writing position (see FIG. 6F).

Note that when a retractable writing element 14 (or 114) is in the writing position, all the first protrusions 1461/11461 of the buttons 14B/114B of the other writing elements 14/114 that are in the retracted position, are axially facing the portions 220A1 of the guide surfaces 220A and the portions 120A1 of the guide surfaces 120A, as represented in FIG. 6F for the button adjacent to the button actuated during the movement described above with reference to FIGS. 6A to 6F. Thus, when another writing element 14 (or 114) is actuated by pushing its button 14B (or 114B) towards the first end 12-1, as represented by the vertical arrow in FIG. 6G, the first protrusion 14B1 of this button cooperates with the first portion 220A1 of the facing guide surface 220A, whereby the ring is rotated in the circumferential direction C1, which has the effect of disengaging the first protrusion 14B1 from the button 14B of the writing element 14 already in the writing position of the shoulder 218A1, whereby, under the effect of the spring 15, this first protrusion 14B1 will be able to engage in a passage 222 so that this writing element in the writing position returns into the retracted position (see FIG. 6H). If the user stops his movement and removes the pressure he exerts on the button 14B (or 114B) of the other writing element 14 (or 114), then this other writing element 14 (or 114) will automatically return into the retracted position under the effect of the spring 15 (or 115). We will be then in the configuration of FIG. 6A. If, on the contrary, the user continues his movement, then the kinematics described with reference to FIGS. 6C to 6F applies, so that this other retractable writing element comes into the writing position. Thus, at most one retractable writing element can be in the writing position.

In this example, the ring 218 makes a rotational movement only in the direction C1 so as to block or release a retractable writing element 14 in the writing position.

As previously, it is noted that the axial distance between the protrusions 14B1 and 1462, respectively 114A1 and 114A2, is greater than the axial length of the passages 222, respectively 122, whereby it is ensured that a single protrusion cooperates with both the pair of guide surfaces.

Although the present disclosure has been described with reference to specific embodiments, it is obvious that modifications and changes can be made to these examples without departing from the general scope of the disclosure as defined by the claims. In particular, individual characteristics of the various illustrated/mentioned embodiments can be combined in additional embodiments. Consequently, the description and drawings should be considered within an illustrative rather than restrictive meaning.

In particular, the ring 18 of the first embodiment may comprise, on its inside face, teeth 118B or 218B of the second or third embodiment, and receive a central button for a retractable writing element rather than a fixed writing element. Conversely, the rings 118 and 218 of the second and third embodiments may comprise no teeth on their inner face, similarly to the ring 18 of the first embodiment and possibly receive a fixed writing element whose tip protrudes from the body 12 from the second end 12-2.

The invention claimed is:

1. A multifunction writing instrument comprising:

a body extending in an axial direction and housing a ring portion movable in rotation about the axial direction, at least two retractable writing elements, and a fixed writing element;

the ring portion having at least two pairs of guide surfaces and the at least two retractable writing elements each including a writing tip and a button, each of the at least two retractable writing elements being movable between a writing position in which the writing tip protrudes from the body and a retracted position in which the writing tip is retracted within the body;

the button of each of the at least two retractable writing elements being configured to cooperate with the at least two pairs of guide surfaces so that actuation of the button of one of the at least two retractable writing elements facilitates movement of the one of the at least two retractable writing elements from the retracted position to the writing position and returns the other of the at least two retractable writing elements from the writing position to the retracted position, whereby at most, only one of the at least two retractable writing elements is in the writing position;

wherein the buttons of the at least two retractable writing elements are each disposed radially outside the ring portion while the fixed writing element extends inside the ring portion.

2. The multifunction writing instrument according to claim 1, wherein the body has a first end and a second end opposite to the first end, the fixed writing element having a writing tip protruding from the second end of the body while the tip of each of the at least two retractable writing elements are configured to alternate in protruding from the first end of the body.

3. The multifunction writing instrument according to claim 1, wherein the button of each of the at least two retractable writing elements includes a protrusion configured to cooperate, respectively, with at least one of the at least two pairs of guide surfaces.

4. The multifunction writing instrument according to claim 3, wherein the body extends in a radial direction and in a circumferential direction, the button of each of the at least two retractable writing elements being axially movable, and the protrusion of the button of one of the at least two retractable writing elements being configured to extend radially towards an inside of the button of another of the at least two retractable writing elements while being offset from each other in the circumferential direction and in the axial direction.

5. The multifunction writing instrument according to claim 4, wherein the button of each of the at least two retractable writing elements has a first end and a second end opposite to the first end; the protrusion of the button of each of the at least two retractable writing elements including a first protrusion disposed at the first end of the button of each of the at least two retractable writing elements and a second protrusion disposed at the second end of the button of each of the at least two retractable writing elements, each pair of the at least two pairs of guide surfaces including a shoulder extending transversely to the axial direction; the first protrusion of the button of each of the at least two retractable writing elements being configured to cooperate in abutment in the axial direction, respectively, with the shoulder associated with each of the at least two pair of guide surfaces to bring each of the at least two writing elements into the writing position.

6. The multifunction writing instrument according to claim 1, wherein a portion of each of the at least two pairs of guide surfaces is oriented towards the second end while the shoulder of each of the at least two pairs of guide surfaces is oriented towards the first end.

7. The multifunction writing instrument according to claim 5, wherein the body extends in a circumferential direction and is concentric with the ring portion, and each pair of the at least two pairs of guide surfaces being spaced to form a passage, the passage formed by each pair of the at least two pairs of guide surfaces extending in the axial direction and being formed between at least one of the at least two pairs of guide surfaces.

8. The multi-function writing instrument according to claim 1, wherein the body extends in a circumferential direction and is concentric with the ring portion, each pair of the at least two pair of guide surfaces forming a single tooth, wherein the at least two pair of guide surfaces form at least two teeth, the at least two teeth being spaced circumferentially about the ring portion.

9. The multifunction writing instrument according to claim 1, wherein the at least two pairs of guide surfaces extend radially.

10. The multifunction writing instrument according to claim 1, wherein the fixed writing element has a writing tip that is connected to a tank housed in the body by a duct housed partly in the body.

11. The multifunction writing instrument according to claim 1, wherein the fixed writing element has a writing tip that is protected by a removable cap.

12. The multifunction writing instrument according to claim 1, wherein the at least two pairs of guide surfaces of the ring are a first guide surface and a second guide surface that each have a first portion and a second portion contiguous to the first portion so that the first portions each form a rotational drive surface of the ring while the second portions each form an abutment surface.

13. The multifunction writing instrument according to claim 12, wherein the first portions of the at least two pairs of guide surfaces extend radially, axially and circumferentially.

14. The multifunction writing instrument according to claim 13, wherein the second portions of the at least two pairs of guide surfaces extend radially and axially only so that the second portions extend parallel to the axial direction while the first portions are inclined relative to the axial direction and oriented towards a second end the body.

15. The multifunction writing instrument according to claim 14, wherein the first portion of one of the at least two pairs of guide surfaces is opposite to the inclination of the first portion of a second of the at least two pairs of guide surfaces.

16. The multifunction writing instrument according to claim 15, wherein one of the second portions is contiguous with a shoulder.

17. The multifunction writing instrument according to claim 1, wherein the button of each of the at least two retractable writing elements includes a first protrusion and a second protrusion that are offset in a circumferential direction and in the axial direction.

18. The multifunction writing instrument according to claim 17, wherein each pair of the at least two pairs of guide surfaces are spaced to form a passage, and wherein the first protrusion and second protrusion have an axial distance therebetween that is greater than an axial length of the passage.

19. The multifunction writing instrument according to claim 17, wherein each pair of the at least two pairs of guide surfaces include a first portion extending transversely to the axial direction, wherein the first protrusion of the button of each of the at least two retractable writing elements being configured to cooperate in abutment in the axial direction with the first portion whereby the ring rotates about the axial direction in a first circumferential direction until the first protrusion enters a straight portion of a passage formed by each pair of the at least two pairs of guide surfaces that are spaced when the button of each of the at least two retractable writing elements is axially displaced.

20. The multifunction writing instrument according to claim 19, wherein by continuing the axial displacement of the button, the first protrusion disengages from the passage while the second protrusion cooperates with the first portion, which has the effect of rotating the ring in the first circumferential direction until the second protrusion engages in the straight portion of the passage.

* * * * *